United States Patent [19]

Brandt

[11] 4,236,193

[45] Nov. 25, 1980

[54] LIGHTING EQUIPMENT

[75] Inventor: Jason M. Brandt, Newport Beach, Calif.

[73] Assignee: Sportolite, Inc., Newport Beach, Calif.

[21] Appl. No.: 12,531

[22] Filed: Feb. 15, 1979

[51] Int. Cl.[3] ..... F21V 1/00

[52] U.S. Cl. ..... 362/241; 362/249; 362/300; 362/301; 362/307; 362/349; 362/431

[58] Field of Search ..... 362/241, 300, 249, 301, 362/431, 307, 349

[56] References Cited

U.S. PATENT DOCUMENTS 3,327,984 6/1967 Rennie ..... 362/382 X

*Primary Examiner*—Stephen J. Lechert, Jr.

*Attorney, Agent, or Firm*—Benoit Law Corporation

[57] ABSTRACT

Lighting equipment includes three distinct spaced, parallel mounting structures held together by sheet metal in a preferably box-shaped configuration. Two outer ones of these mounting structures each include a profile having a wall thickness greater than the thickness of the sheet metal and an interior configuration corresponding to an exterior configuration of each of two arms of a lamp to be mounted relative to a pole. The central one of the mentioned elongate mounting structures has a profile including combined first, second and third walls, each of which has a thickness greater than the mentioned sheet metal thickness. The third wall is centrally located and carries a tapered-bore or other structure for connection to the pole on which the lamp is to be mounted. The lamp itself may be box-shaped and partly formed of sheet metal, and include a metal plate thicker than such sheet metal and having spaced first and second projection for attachment to mounting arms partly accommodated in the above mentioned outer mounting structures.

23 Claims, 6 Drawing Figures

LIGHTING EQUIPMENT

BACKGROUND OF THE INVENTION

1. Field of the Invention

The subject invention relates to electric illumination systems, lighting equipment and fixtures, including systems, fixtures, lamps and lamp parts for illuminating indoor and outdoor areas.

2. Prior-Art Statement

While the lighting system and equipment herein disclosed has utility in many fields of illumination, it is particularly suited for the flood lighting of tennis courts, multi-purpose courts, game courts, softball diamonds, baseball infields, parking areas, as well as for security lighting and general area lighting.

Prior to the subject invention, I designed and publically used lighting equipment including one or two box-shaped lamps, each having two parallel projecting mounting arms accommodated at opposite sides of a pole-mounted box made of sheet metal. The inside of the pole-mounted box was divided by sheet metal compartments which ran parallel to the mounting arms in a central location of the box. Electric lamp ballast equipment was located in compartments thus formed in the box.

This earlier design has inherent mechanical limitations which were not surmountable on the basis of a sheet metal construction.

In a similar vein, the flat glass panels I employed at the underside of each lamp eventuated losses on the order of 20% through total reflection, leading to the need of increased wattage and the occurrence of disturbing glare.

Also, the flatness of the mentioned glass panels exposed them to localized heat from adjacent high-power lamps, thereby increasing the required height of the lighting fixture, and precluding the use of substances other than glass for the transparent panel.

SUMMARY OF THE INVENTION

It is a general object of this invention to overcome the disadvantages expressed or implicit in the above mentioned prior-art statement.

It is a related object of this invention to overcome for specific equipment or equipment parts specific aspects of the above mentioned disadvantages.

It is a germane object of this invention to provide improved lighting systems and equipment.

It is a related object of this invention to provide improved lighting systems and equipment particularly suited for tennis courts, multi-purpose courts, game courts, softball diamonds, baseball infields, parking areas, and for security lighting and general area lighting.

It is also an object of this invention to provide improved lighting apparatus mountable on a pole, and improved apparatus for mounting one or more lamps relative to a pole or lamp post.

It is also an object of this invention to provide at least partly light transmissive shaped sheets for covering light transmitting openings of lamps.

Other objects of this invention will become apparent in the further course of the subject disclosure.

From a first object thereof, the subject invention resides in apparatus for mounting a lamp relative to a pole with the aid of sheet metal of predetermined thickness, the lamp having mutually spaced first and second mounting arms of a predetermined exterior configuration. The apparatus according to this aspect of the subject invention comprises, in combination, a first elongate mounting structure including a profile having a wall thickness greater than said predetermined thickness and an interior configuration corresponding to said exterior configuration, for accommodating said first arm, a second elongate mounting structure spaced from and extending parallel to said first elongate mounting structure and including a profile having a wall thickness greater than said predetermined thickness and an interior configuration corresponding to said exterior configuration, for accommodating said second arm, a third elongate mounting structure spaced from and located between said first and second mounting structures and having a profile including a first wall of a thickness greater than said predetermined thickness and extending parallel to said first and second elongate mounting structures, a second wall of a thickness greater than said predetermined thickness and extending parallel to said first wall, and a third wall of a thickness greater than said predetermined thickness and extending between said first and second walls, and means for connecting said third wall to said pole, and means including said sheet metal for mounting said first and second mounting structures relative to said third mounting structure.

From another aspect thereof, the subject invention resides in lighting apparatus mountable on a pole, comprising in combination a box-shaped lamp fixture partly formed of sheet metal and having a side formed of a metal plate thicker than said sheet metal and having spaced first and second projections, a first mounting arm attached to said first projection and extending from said metal plate, a second mounting arm attached to said second projection and extending from said metal plate in parallel to said first arm, a first elongate mounting structure including a profile having a wall thickness greater than the thickness of said sheet metal and an interior configuration corresponding to an exterior configuration of said first arm, for accommodating said first arm, a second elongate mounting structure spaced from and extending parallel to said first elongate mounting structure and including a profile having a wall thickness greater than the thickness of said sheet metal and an interior configuration corresponding to an exterior configuration of said second arm, for accommodating said second arm, a third elongate mounting structure spaced from and located between said first and second mounting structures and having a profile including a first wall of a thickness greater than the thickness of said sheet metal and extending parallel to said first and second elongate mounting structures, a second wall of thickness greater than the thickness of said sheet metal and extending parallel to said first wall, and a third wall of a thickness greater than the thickness of said sheet metal and extending between said first and second walls, and means for connecting said third wall to said pole, and means including sheet metal of a thickness smaller than any of said wall thickness in said first, second and third mounting structures for mounting said first and second mounting structures relative to said first mounting structure.

From another aspect thereof, the subject invention resides in an at least partly light transmissive shaped sheet for covering a light transmitting opening of a lamp, comprising in combination a rectangular rim portion lying in a plane, a first wall adjacent one side of said rim portion and inclined relative to said plane, and a second wall extending from adjacent an opposite side of said rim portion toward said first wall and being inclined relative to said plane, said first wall being shorter, and inclined relative to said plane at a steeper angle, than said second wall.

BRIEF DESCRIPTION OF THE DRAWINGS

The subject invention and its various aspects and objects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
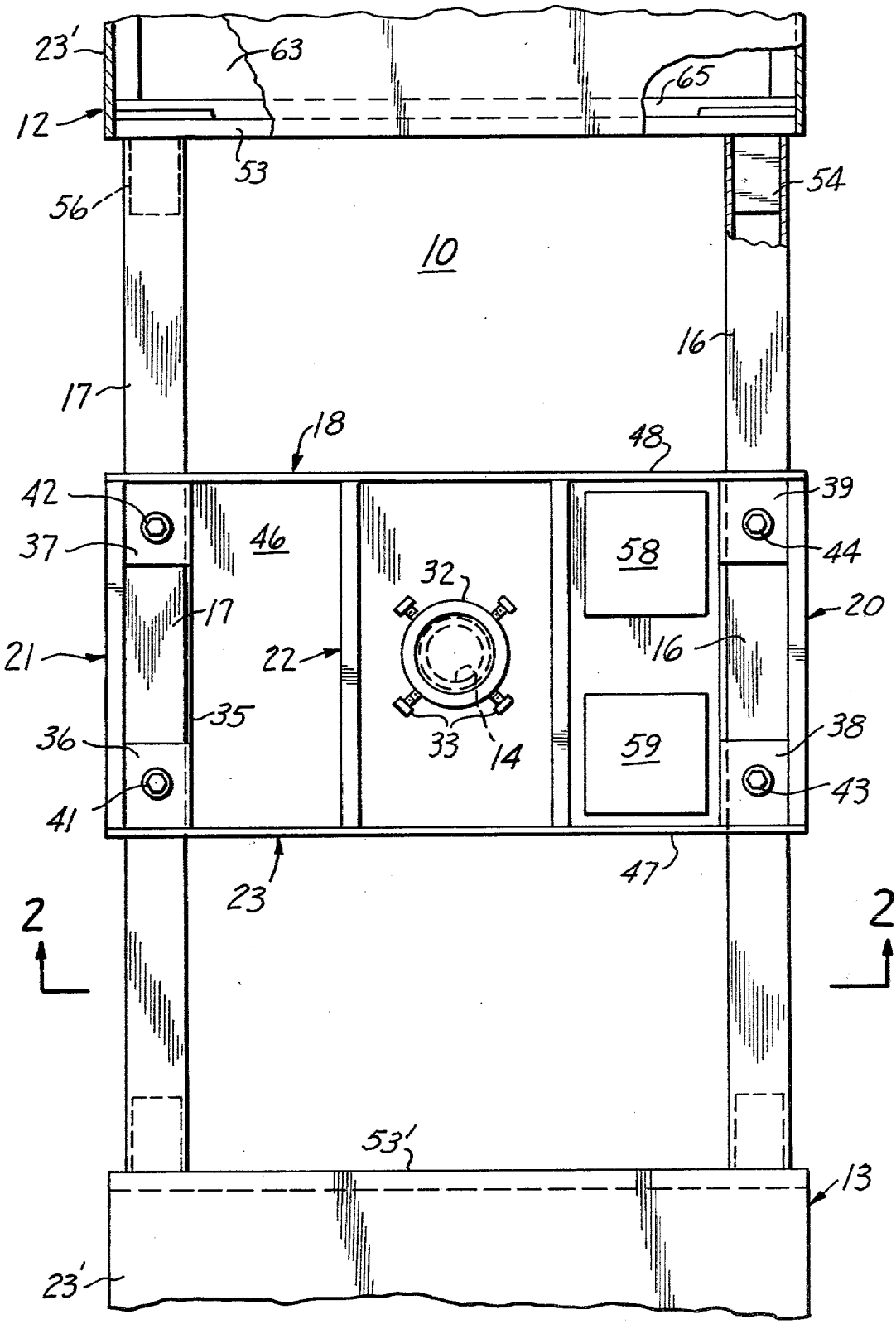
FIG. 1 is a top view, partially broken off, of a lighting apparatus according to a preferred embodiment of the subject invention.

The lighting apparatus 10 shown in the drawings mounts a pair of lamps 12 and 13 relative to a pole or lamppost 14, shown in dotted outline.

Each of the lamps has mutually spaced first and second mounting arms 16 and 17 of a predetermined exterior configuration projecting therefrom.

An apparatus 18 for mounting the lamps 12 and 13, or for mounting either of these lamps as desired, includes distinct first, second and third elongate mounting structures 20, 21 and 22. Sheet metal 23 of a predetermined thickness is employed to mount the first and second mounting structures 20 and 21 relative to the third mounting structure 22.

Figure 2:
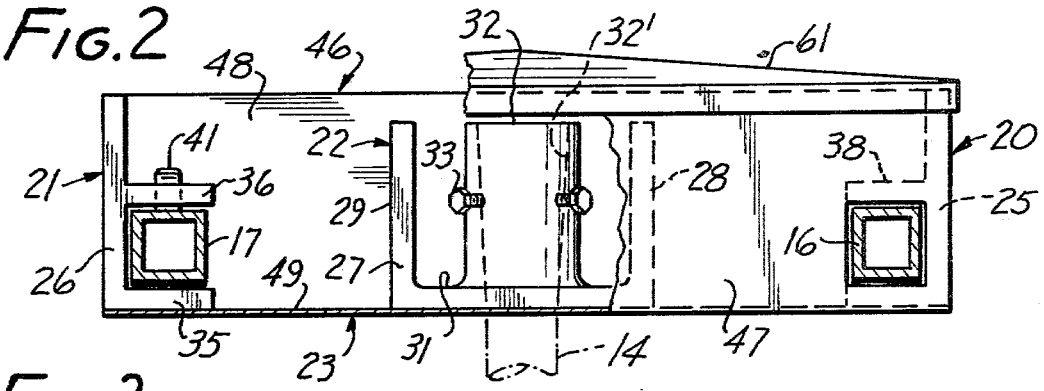
FIG. 2 is a view, partially in section, taken along the line 2—2 in FIG. 1.
Figure 3:
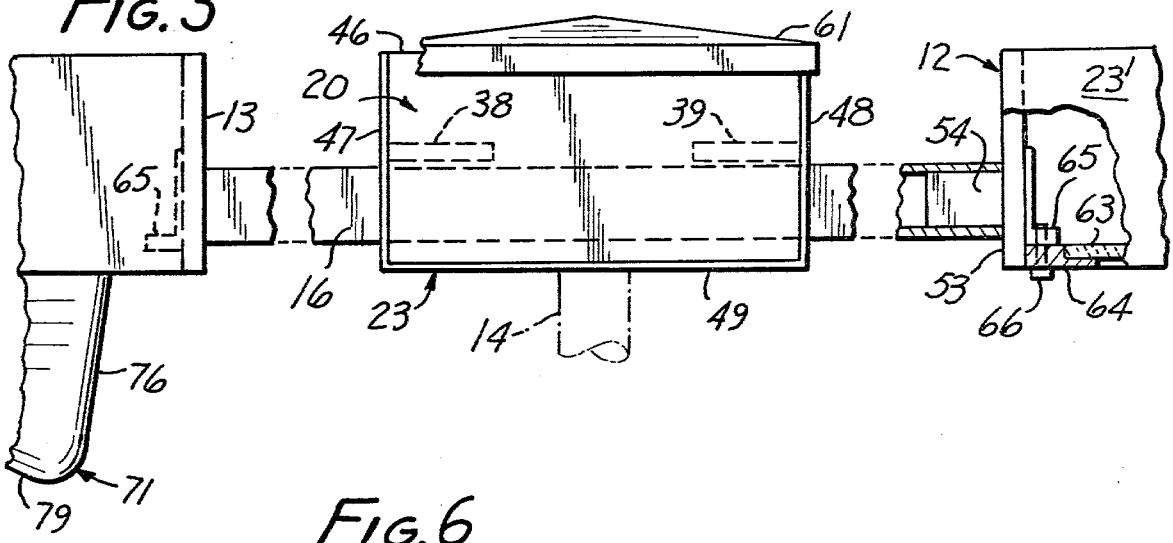
FIG. 3 is a side view of the lighting apparatus of FIG. 1.

The first elongate mounting structure 20 includes a profile 25 having a wall thickness greater than the predetermined thickness of the sheet metal 23 and having an interior configuration corresponding to the exterior configuration of the first arm 16, for an accommodation of that first arm in the first mounting structure 25, as shown in FIGS. 1 to 3.

The second elongate mounting structure 21 is spaced from and extends parallel to the first elongage mounting structure 20 and includes a profile 26 having a wall thickness greater than the predetermined thickness of the sheet metal 23 and an interior configuration corresponding to the exterior configuration of the second mounting arm 17, for an accommodation of that second arm in the second mounting structure 21, as shown in FIGS. 1 to 3.

The third elongate mounting structure 22 is spaced from and located between the first and second mounting structures 20 and 21 and has a profile 27 including a first wall 28 extending parallel to the first and second elongate mounting structures 20 and 21, a second wall 29 extending parallel to the first wall 28 and a third wall 31 extending between the first and second walls 28 and 29. Each of the first, second and third walls 28, 29 and 31 has a thickness greater than the predetermined thickness of the sheet metal 23.

The third elongate mounting structure 22 includes means for connecting the third wall 31 to the pole 14. In the illustrated embodiment, these means include a hollow member or structure 32 which is attached to and preferably integral with the mounting structure 22, and several bolts which are threaded into the wall of the mounting member 32 so as to engage a top portion of the pole 14, which extends into the mounting member 32 through an aperture in the sheet metal 23 and wall portion 31. The structure 32 or its internal bore has an axis of symmetry extending parallel to the first and second walls 28 and 29.

The profile 25 in the first elongate mounting structure 20 and the profile 26 in the second elongate mounting structure 21 preferably are L-shaped for accommodating first and second arms 16 and 17 of square configuration. Moreover, in accordance with the illustrated preferred embodiment of the subject invention, the profile 25 in the first elongate mounting structure 20 and the profile 26 in the second elongate mounting structure 21 are F-shaped for accommodating between parallel bars first and second arms 16 and 17 of square configuration.

In this respect, FIG. 2 shows parallel bars 35 and 36 of the F-shaped profile 26 of the elongate mounting structure 21, for accommodating therebetween the square-shaped mounting arm 17. As seen jointly in FIGS. 1 to 3, the preferred F-shaped mounting structure profile may be realized with the aid of spaced bars, lugs or shelves 36 to 39 which may have fasteners 41 to 44 threaded therein for releasable attachment to mounting arms 16 and 17.

If two lamps 12 and 13 are to be mounted relative to the pole 14, then a first mounting arm 16 for both lamps 12 and 13 preferably extends through the first elongate mounting structure 20, while a second mounting arm 17, also for both lamps 12 and 13, then extends through the second elongate mounting structure 21. On the other hand, the mounting arms 16 and 17 may be shorter and extend only into the first and second mounting structures 20 and 21 from one side, if only one of the two lamps 12 and 13 is to be mounted in a particular installation.

In the illustrated preferred embodiment of the subject invention, the first, second and third walls 28, 29 and 31 jointly form a profile having a U-shaped configuration. The third mounting structure 22 may thus comprise a channel iron or a channel profile of another metal. For instance, aluminum or aluminum alloy castings may be employed for the mounting structures 20, 21 and 22.

The sheet metal 23 and the first and second elongate mounting structures 20 and 21 jointly form a box-like structure 46 for receiving portions of the pole 14 and arms 16 and 17.

The box-like structure 46 preferably has opposite walls 47 and 48 attached to opposite ends of the first and second walls 28 and a bottom 49 having a portion extending along the third wall 31 of the third mounting structure 22.

In accordance with an illustrated preferred embodiment of the subject invention, the sheet metal 23 is in a U-shaped configuration, having leg portions at the walls 47 and 48 and a bight portion at the bottom 49, attached to and extending between the first and second mounting structures 20 and 21. The first and second walls 28 and 29 are then attached to and extend between the leg or wall portions 47 and 48, and the third wall 31 extends along part of the bight or bottom portion 49 of the sheet metal box 46.

All attachments herein mentioned or otherwise deemed desirable, between the sheet metal and the profiled mounting structures may be effected by welding or in any other suitable manner.

Each of the box-shaped lamp fixtures 12 and 13 is partly formed of sheet metal 23' and has a side formed of a metal plate 53 being thicker than the sheet metal 23 or 23' and having spaced first and second nipples or projections 54 and 56. In this respect, the sheet metal 23' may have the same thickness as the sheet metal 23, or a similar thickness, as desired. In either case, not only the wall thickness of the mounting plate 53, but also the wall thickness of the profiles of the first, second and third mounting structures 20, 21 and 22 are greater than the thickness of sheet metal 23 and sheet metal 23'.

The first mounting arm 16 is attached to the first lamp fixture projection 54 and extends from the metal plate 53. Similarly, the second mounting arm 17 is attached to the second projection 56, and extends from the metal plate 53 in parallel to the first arm 16.

The second box-shaped lamp fixture 13 is also partly formed of sheet metal 23' and has a side formed of a metal plate 53' having the above mentioned first and second projections, like the metal plate 53 of the lamp fixture 12. The first mounting arm 16 extends through the first mounting structure 20 as already mentioned, being attached to the first projections 54 of the first and second lamp pictures 12 and 13. The second mounting arm 17 similarly extends through the second mounting structure 21, being attached to the second projections 56 of the first and second lamp fixtures.

The structure so far described with reference to FIGS. 1 to 3 of the drawings is free of the above mentioned disadvantage of the prior construction made only of sheet metal. Especially in outdoor installations, the structure and construction according to the subject invention are highly advantageous and are, for instance, capable of withstanding high-velocity wind and rough weather.

As indicated by a slanted dotted line 32' in FIG. 2, the mounting structre 32 according to a preferred embodiment of the subject invention has a frusto-conical or tapered bore for receiving the pole 14. The taper of that bore preferably runs downwardly or toward the ground in which the pole 14 is set, with the diameter of that bore being smaller at the portion 31 than at the top of the structure 32. This, in practice, enables the installer to level the lighting apparatus 10 relative to the pole 14 by differential adjustment of the bolts 33.

Electrical apparatus or components, such as lamp ballasts, transformers and capacitors may be located or mounted in the compartments provided between the first and third and second and third mounting structures as partially shown at 58 and 59 in FIG. 1. Also, the top of the box-shaped structure 46 may be closed by a lid 61 which preferably has a slanted roof for improved water runoff.

As shown at the right-hand side in FIG. 3, it is within the broad contemplation of the subject invention that the lamp fixture 12 be closed at the bottom by a flat plate 63 of glass or other transparent or translucent material. The plate for panel 63 is mounted in a hinged frame 64 that is releasably attached to a ledge 65 by screws 66. The ledge 65 typically is integral with the above mentioned lamp fixture plate 53.

In practice, a flat panel 63 causes light losses on the order of 20% through total reflection, especially if the lamps inside the fixture are located in the vicinity of the mounting plate 53, in order to cast most of the light at an angle from the mounting pole 14. Also, the light transmissive panel 63 either has to be mounted at a sufficient spacing of the high-powered lamps in the fixture to avoid damage thereof through excessive heating, or has to be made of a heat-resistant material. In many cases, the required sufficient spacing would result in a very high and heavy lamp fixture. Also, the requirement that the panel 63 be very heat resistant often excludes the use of relatively inexpensive and light materials, such as plastics, and requires the use of glass.

This is not only expensive but also raises the danger of injury through breakage of the glass in a sport or other outdoor environment. Moreover, a flat light transmitting panel 63 lets a lot of light go to waste in the area of the lamppost 14 or at adjacent locations where the light is not needed in a given application.

The at least partly light transmissive shaped sheet or panel according to the subject invention avoids these problems. In particular, the preferred embodiment shown in FIGS. 4 to 6 and partly also on the left-hand side of FIG. 3, serves to cover a light transmitting opening of a lamp or fixture, such as the opening 72 shown in FIG. 6 of the lamp fixture 13.

The lamp fixture 13 as such is constructed in the same manner as the lamp fixture 12, with like reference numerals as among the lamp fixtures 12 and 13 designating like or functionally equivalent parts.

In practice, part shown at 71 is sometimes referred to as "lens," "diffuser" or "panel". However, the term "lens" is more appropriately applied to a piece of glass or other transparent substance with two curved surfaces, or one plane and one curved surface, and since the structure 71 need not necessarily exert a diffusing action, the structure 71 is simply referred to herein as a shaped sheet.

Figure 6:
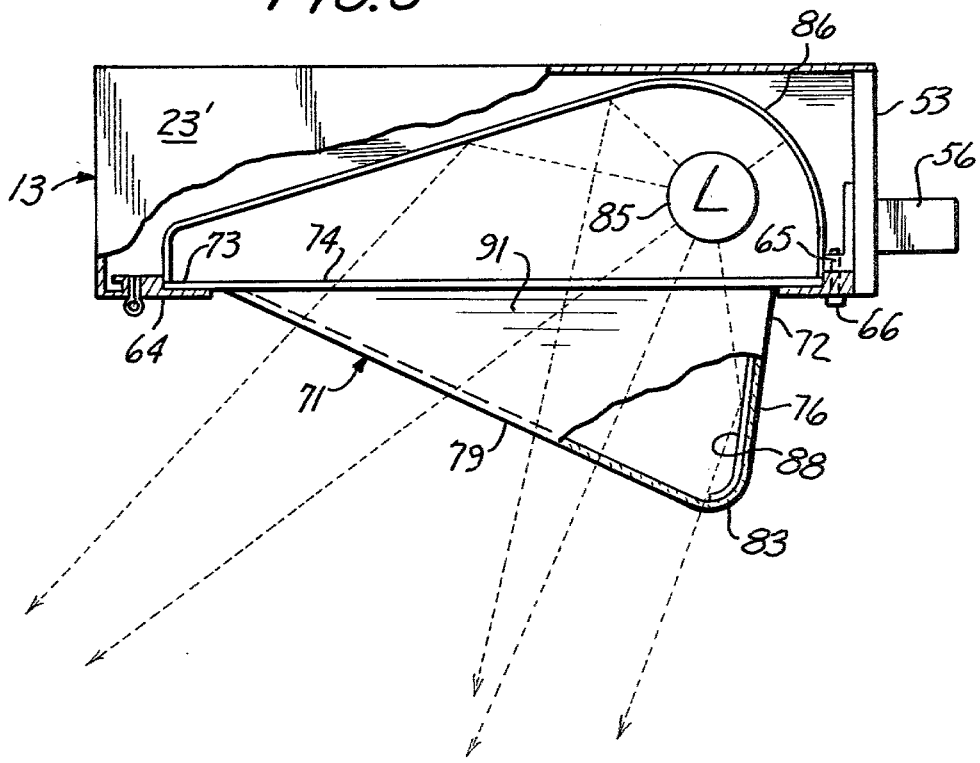
FIG. 6 is a side view of one of the lamps of the apparatus of FIGS. 1 to 3 with mounted shaped sheet according to FIGS. 4 and 5.
Figure 5:
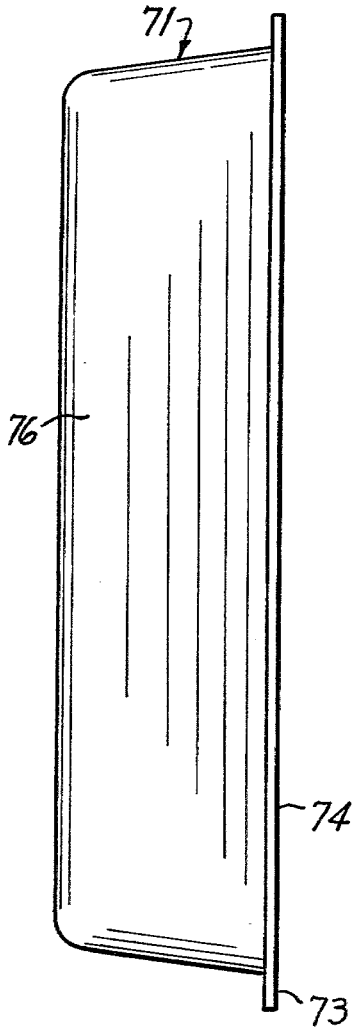
FIG. 5 is a first side view of the shaped sheet of FIG. 4.
Figure 4:
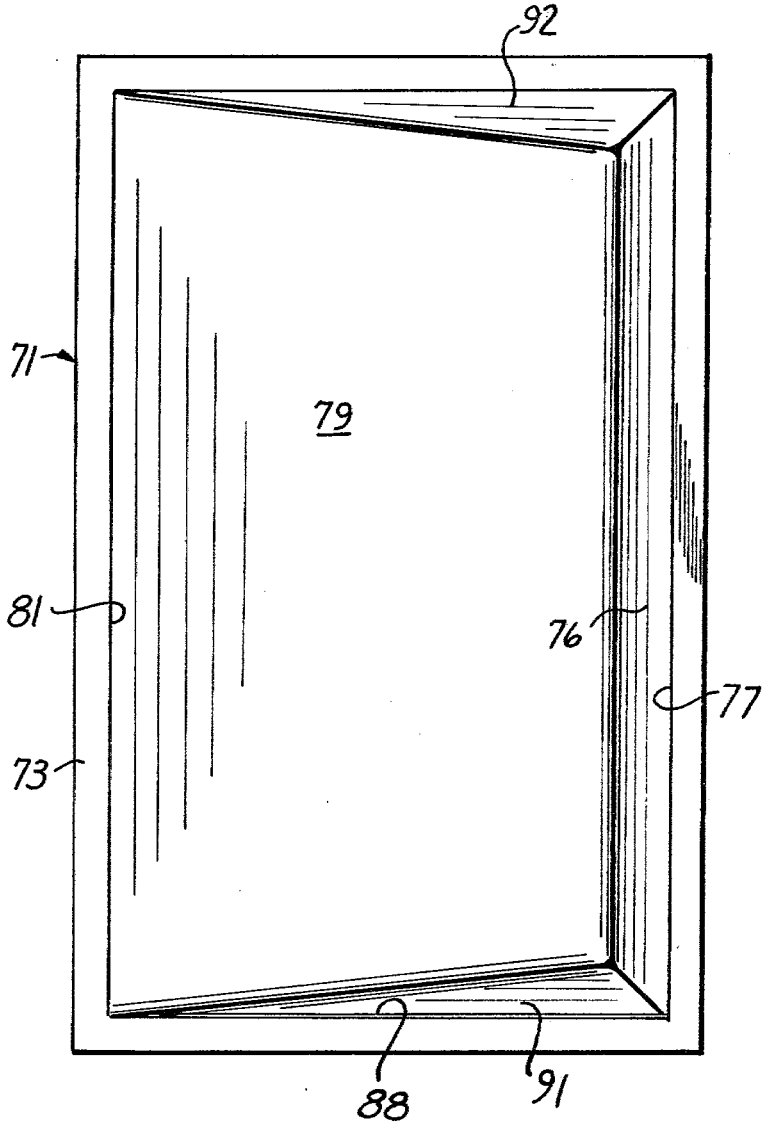
FIG. 4 is a plan view of an at least partly light transmissive shaped sheet according to a further preferred embodiment of the subject invention, for covering a light transmitting lamp opening.

As seen in FIG. 4 to 6, the shaped sheet 71 has a rectangular rim portion 73 lying in a plane 74 which is also the plane of the light transmitting opening 72 or the hinged mounting frame 64.

The shaped sheet 71 further has a first surface or wall 76 adjacent one side 77 of the rim 73. The first wall or surface 76 is inclined relative to the plane 74 and, as seen in FIG. 3, faces towards the pole or lamppost 14 when the third wall 31 of the mounting structure 22 is connected to such pole or, in other words, when the illustrated lighting equipment is mounted on such pole.

The shaped sheet 71 also has a second surface or wall 79 extending from adjacent an opposite side 81 of the rim 73 and being inclined relative to the plane 74. The second surface or wall 79 faces away from the pole 14 in the mounted condition of the fixture.

According to the subject invention, the first surface or wall 76 is shorter than the second surface or wall 79, and the first surface 76 is inclined relative to the plane 74 at a steeper or larger angle than the second surface or wall 79. In this manner, the crest or highest portion 83 of the shaped sheet 71 is closer to the one side 77 than to the opposite side 81 of the rim portion 73. This crest 83 also runs parallel to the sides 77 and 81.

As seen in FIG. 6, the light source or lamp 85 is located to one side of the lamp fixture and the shaped sheet crest or lowest drooping portion 83 is correspondingly located to one side of the lamp fixture. Moreover, a reflector 86 for the lamp 85 and the sheet or panel 71 are similarly shaped in a mirror-image fashion.

In practice, this aids in throwing the light from the lamp 85 in a direction approximately perpendicular to the inclined shaped sheet surface or wall 79, as seen in FIG. 6.

This effect is enhanced in accordance with a further embodiment of the subject invention by making the sheet 71 more light transmissive at the second surface or wall 79 than at the first surface or wall 76.

In practice, this may be accomplished by making the sheet opaque or only poorly translucent at the first surface or wall 76. For best results, a light reflective or mirror coating 88 may be applied to the first wall 76 to render such first wall light reflective or to render the sheet 71 light reflective at the first surface 76.

The shaped sheet 71 further has side walls 91 and 92 having the first and second surfaces or wall portions 76 and 79 extending therebetween. Preferably, and as shown in FIGS. 4 to 6, the rim portion 73 and walls 76, 79, 91 and 92 are integral with each other, having been molded or deep drawn from one sheet of plastic. The second wall 79 also may be more light transmissive than the side walls 91 and 92, and such side walls may preferably be provided with a reflective coating or may otherwise be mirrored, like the steep first wall 76.

In practice, the steepness of the first wall 76 preferably is more than 80° relative to the plane 74.

In principle, the sheet 71 could be made of glass, but it is more practical and safer to make it of plastic, inasmuch as the configuration of the shaped sheet 71 removes it sufficiently from the light source 85 or from the one or two lamps situated at the location 85. Also, a plastic material is generally more shatterproof than glass and may even be provided with an ultraviolet resistant coating to enable the use of mercury vapor and similar gas discharge lamps.

It is also within the broad contemplation of the subject invention, that the shaped sheet be used in conjunction with a glass panel extending in the plane 74. However, such combination is not generally preferred when losses through total reflection are to be avoided. Also, the use of a sodium vapor lamp or lamps at 85 generally dispenses with the need for an intervening glass plate.

It is thus seen that the subject invention and its various aspects overcome the disadvantages of prior-art structures and proposals and present lighting equipment of superior design and function.

The construction and characteristics herein disclosed render the lighting equipment according to the subject invention and its embodiments not only suitable for the purpose expressly disclosed above, but also for street lighting purposes and in other situations where lamps are to be mounted at the side of an area to be illuminated. Also, the shaped lighting fixture panel of the subject invention obviously has utility in light fixtures other than the fixtures specifically disclosed. For instance, such shaped panel could be employed as a diffuser in flourescent lamps in lieu of the presently prevailing flat-type of diffuser.

Other modifications and variations within the spirit and scope of the subject invention and its various aspects will become apparent or suggested to those skilled in the art by my subject extensive disclosure.

I claim:

1. Apparatus for mounting a lamp relative to a pole with the aid of sheet metal of predetermined thickness, said lamp having mutually spaced first and second mounting arms of a predetermined exterior configuration, comprising in combination:

a first elongate mounting structure including a profile having a wall thickness greater than said predetermined thickness and an interior configuration corresponding to said exterior configuration, for accommodating said first arm;

a second elongate mounting structure spaced from and extending parallel to said first elongate mounting structure and including a profile having a wall thickness greater than said predetermined thickness and an interior configuration corresponding to said exterior configuration, for accommodating said second arm;

a third elongate mounting structure spaced from and located between said first and second mounting structures and having a profile including a first wall of a thickness greater than said predetermined thickness and extending parallel to said first and second elongate mounting structures, a second wall of a thickness greater than said predetermined thickness and extending parallel to said first wall, and a third wall of a thickness greater than said predetermined thickness and extending between said first and second walls, and means for connecting said third wall to said pole; and means including said sheet metal for mounting said first and second mounting structures relative to said third mounting structure.

2. Apparatus as claimed in claim 1, wherein:

said profile in said first elongate mounting structure and said profile in said second elongate mounting structure are L-shaped for accommodating first and second arms of square configuration.

3. Apparatus as claimed in claim 1, wherein:

said profile in said first elongate mounting structure and said profile in said second elongate mounting structure are F-shaped for accommodating between parallel bars first and second arms of square configuration.

4. Apparatus as claimed in claim 1, wherein:

said means for connecting said third wall to said pole include structure having a tapered bore and being attached to said third wall and having an axis of symmetry extending parallel to said first and second walls.

5. Apparatus as claimed in claim 1, 2, 3 or 4, wherein:

said first, second and third walls jointly form a profile having a U-shaped configuration.

6. Apparatus as claimed in claim 1, 2, 3 or 4, wherein:

said sheet metal and said first and second elongate mounting structures jointly form a box-like structure for receiving portions of said pole and said arms.

7. Apparatus as claimed in claim 6, wherein:

said box-like structure has opposite walls attached to opposite ends of said first and second walls and a bottom having a portion extending along said third wall.

8. Apparatus as claimed in claim 1, 2, 3 or 4, wherein:

said sheet metal is in a U-shaped configuration, having leg portions and a bight portion attached to and extending between said first and second mounting structures.

9. Apparatus as claimed in claim 8, wherein:

said first and second walls are attached to and extend between said leg portions and said third wall extends along part of said bight portion.

10. Lighting apparatus mountable on a pole, comprising in combination:

a box-shaped lamp fixture partly formed of sheet metal and having a side formed of a metal plate thicker than said sheet metal and having spaced first and second projections;

a first mounting arm attached to said first projection and extending from said metal plate;

a second mounting arm attached to said second projection and extending from said metal plate in parallel to said first arm;

a first elongate mounting structure including a profile having a wall thickness greater than the thickness of said sheet metal and an interior configuration corresponding to an exterior configuration of said first arm, for accommodating said first arm;

a second elongate mounting structure spaced from and extending parallel to said first elongate mounting structure and including a profile having a wall thickness greater than the thickness of said sheet metal and an interior configuration corresponding to an exterior configuration of said second arm, for accommodating said second arm;

a third elongate mounting structure spaced from and located between said first and second mounting structures and having a profile including a first wall of a thickness greater than the thickness of said sheet metal and extending parallel to said first and second elongate mounting structures, a second wall of a thickness greater than the thickness of said sheet metal and extending parallel to said first wall, and a third wall of a thickness greater than the thickness of said sheet metal and extending between said first and second walls, and means for connecting said third wall to said pole; and means including sheet metal of a thickness smaller than any of said wall thickness in said first, second and third mounting structures for mounting said first and second mounting structures relative to said first mounting structure.

11. Apparatus as claimed in claim 10, including:

a second box-shaped lamp fixture partly formed of sheet metal and having a side formed of a metal plate having spaced first and second projections;

said first mounting arm extending through said first mounting structure and being attached to said first projection of said second lamp fixture; and said second mounting arm extending through said second mounting structure and being attached to said second projection of said second lamp fixture.

12. Apparatus as claimed in claim 10, wherein:

said box-shaped lamp fixture has a light transmitting opening covered by an at least partly light transmissive shaped sheet having a first surface inclined relative to a plane of said opening and facing toward said pole when said third wall is connected to said pole, and a second surface inclined relative to said plane and facing away from said pole;

said first surface being shorter, and inclined relative to said plane at a steeper angle, than said second surface.

13. Apparatus as claimed in claim 12, wherein:

said shaped sheet has side walls having said first and second surfaces extending therebetween.

14. Apparatus as claimed in claim 12 or 13, wherein:

said sheet is more light transmissive at said second surface than at said first surface.

15. Apparatus as claimed in claim 12 or 13, wherein:

said sheet is light reflective at said first surface.

16. Apparatus as claimed in claim 13, wherein:

said sheet is more light transmissive at said second surface at said side walls.

17. Apparatus as claimed in claim 13, wherein:

said side walls are light reflective.

18. An at least partly light transmissive shaped sheet for covering a light transmitting opening of a lamp, comprising in combination:

a rectangular rim portion lying in a plane;

a first wall adjacent one side of said rim portion and inclined relative to said plane; and a second wall extending from adjacent an opposite side of said rim portion toward said first wall and being inclined relative to said plane;

said first wall being shorter, and inclined relative to said plane at a steeper angle, than said second wall.

19. A shaped sheet as claimed in claim 18, including:

side walls having said first and second walls extending therebetween.

20. A shaped sheet as claimed in claim 18 or 19, wherein:

said second wall is more light transmissive than said first wall.

21. A shaped sheet as claimed in claim 18 or 19, wherein:

said first wall is light reflective.

22. A shaped sheet as claimed in claim 19, wherein:

said second wall is more light transmissive than said side walls.

23. A shaped sheet as claimed in claim 19, wherein:

said side walls are light reflective.

* * * * *